United States Patent [19]

Oppenlander et al.

[11] 4,183,701

[45] Jan. 15, 1980

[54] COUPLING GEAR FOR LEMNISCATE SHIELD TIMBERING FRAME

[75] Inventors: Harry Oppenländer, Wetter; Peter Naundorf, Duisburg, both of Fed. Rep. of Germany

[73] Assignee: Thyssen Industrie AG, Fed. Rep. of Germany

[21] Appl. No.: 951,039

[22] Filed: Oct. 13, 1978

[30] Foreign Application Priority Data

Oct. 13, 1977 [DE] Fed. Rep. of Germany ..... 2746031

[51] Int. Cl.[2] ..... E21D 15/44

[52] U.S. Cl. ..... 405/295; 405/291

[58] Field of Search ..... 405/291–301; 299/31, 33; 91/170 MP; 248/357

[56] References Cited

FOREIGN PATENT DOCUMENTS

| | | | |
|---|---|---|---|
| 1077619 | 3/1960 | Fed. Rep. of Germany | 405/292 |
| 1245294 | 7/1967 | Fed. Rep. of Germany | 405/292 |
| 1903890 | 2/1972 | Fed. Rep. of Germany | 405/292 |

*Primary Examiner*—Dennis L. Taylor

*Attorney, Agent, or Firm*—McGlew and Tuttle

[57] ABSTRACT

A coupling gear for connecting two side-by-side, longitudinally extending shiftable skids of a divided footwall skid of a lemniscate shield timbering frame for actuation by a fluid pressure operated piston and cylinder combination which is adapted to be connected thereto, comprises, a double crank joint which includes first and second outer crank pins extending transversely between the skids with bracket means adapted to be positioned on the respective skids for rotatably supporting the outer crank pins on the respective skids and, wherein, the crank pins have outer ends rotatably supported in the bracket means and opposite inner ends and including first and second longitudinally extending, substantially parallel crank arms, one of which has a first end connected to the inner end of the first outer crank pin and the other of which has a first end freely rotatable on the second outer crank pin and with a central crank pin having a first end freely rotatable in the first crank pin arm opposite end and an opposite second end non-rotatably connected to the second crank arm opposite said end, and with one of the crank pins extending inwardly of its associated crank arm and providing a connection to the piston and cylinder combination.

5 Claims, 7 Drawing Figures

COUPLING GEAR FOR LEMNISCATE SHIELD TIMBERING FRAME

FIELD AND BACKGROUND OF THE INVENTION

This invention relates to underground tunneling devices in general and, in particular, to a new and useful coupling gear for the connection of a moving device, in particular, a moving cylinder, to a divided sill skid of a lemniscate shield timbering frame, wherein the moving cylinder runs between the skid halves and is connected with them in the vicinity of their front ends, and the skid halves are coupled together for vertical relative movement.

DESCRIPTION OF THE PRIOR ART

When during the advance of a shield timbering frame, uneven areas of the footwall, such as, cracks, ground sills or the like must be run over, this may lead to undesired slanting of the timbering frame, which interferes with the moving process. In order to avoid such impairment to the extent possible, the use of a divided sill skid has been adopted, the skid halves of which can be raised independently of each other, so that a better adaptation to unevennesses of the footwall is possible, and thereby, slanting of the timbering frame can be avoided.

Because of the relative movements between the two halves of a divided footwall skid, special measures must be taken for the connection of a moving device. In a known shield timbering frame, the two skid halves are connected together by resilient elements. It is also known how to ensure the required mobility for the connection of the moving device by appropriately designed three-dimensional joints.

The previously known systems for the connection of a moving device to a divided footwall skid are unsuitable for shield timbering frames with lemniscate conduction. This is due above all to the fact that, upon reverse pressurization of a supporting cylinder for raising one skid half, the skid tip moves, not on an arc of circle, but on a curve which is the result of the lemniscate conduction, and which causes the raised skid half to execute a forward movement simultaneously with the raising so that its tip will be farther forward than the skid half which has not been raised.

SUMMARY OF THE INVENTION

The present invention provides a lemniscate shield timbering frame having a divided footwall skid, a coupling gear for the connection of a moving device which does not hinder the relative movements of the skid halves and yet permits central application of force of the moving device in relation to both skid halves.

According to the invention, the coupling between the skid halves is designed as a double crank joint having two outer crank pins extending crosswise to the length of the skids. The crank pins engage in cutouts, preferably slots, extending in a vertical direction on parallel brackets fastened to the respective skid halves. The crank pins are freely rotatable, but are axially non-displaceable, and are mounted at their inner ends on codirectional parallel crank arms which are free to rotate on one end and are non-rotational on their other ends. The crank arms are interconnected by a common central crank pin which is mounted freely rotatable on the crank arm with the non-rotational connection of the outer crank pin and is mounted non-rotationally at the other crank arm. One of the outer crank pins is extended inwardly beyond the crank arm and beyond the median plane of the timbering frame and serves as the connecting element for the moving cylinder.

The coupling gear according to the invention consists of time-tested joint elements having a small number of parts, which can withstand high stresses. With respect to the mode of operation, the coupling gear offers the advantage that due to the lemniscate conduction, the respective skid half to be raised is not subjected to any impediment in its special movement course, and that even with the skid half raised, a central transmission of force from the moving device to the timbering frame is ensured.

Accordingly, an object of the invention is to provide a coupling gear for connecting two side-by-side longitudinally extending shiftable skids of a divided footwall skid of a lemniscate shield timbering frame for actuation by a fluid pressure operated piston and cylinder combination which is adapted to be disposed between the skids and connected thereto, which includes a double crank joint made up of first and second outer crank pins extending transversely between the skids and having inner ends rotatably supported on the brackets mounted on the skids and outer ends which engage into respective crank arms with one outer crank pin being secured to the crank arm against rotation in respect thereto and the other being freely rotatable in the crank arm and which further includes a central crank pin which extends between the crank arms and is secured at its one end to the crank arm which is rotatable on its associated crank pin and is rotatable on the crank arm which is secured to its associated outer crank pin and, wherein, one of the outer crank pins is extended inwardly and engaged with the piston and cylinder combination.

A further object of the invention is to provide a coupling gear fro connecting two side-by-side longitudinally extending shiftable skids which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
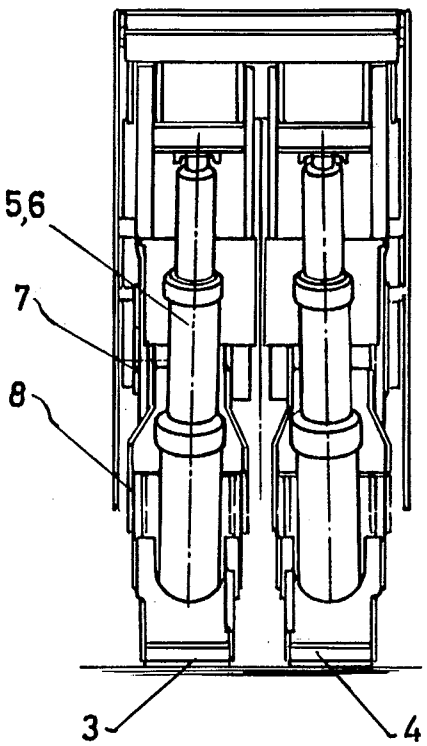
FIG. 2 is a front view of the shield timbering frame shown in FIG. 1.
Figure 1:
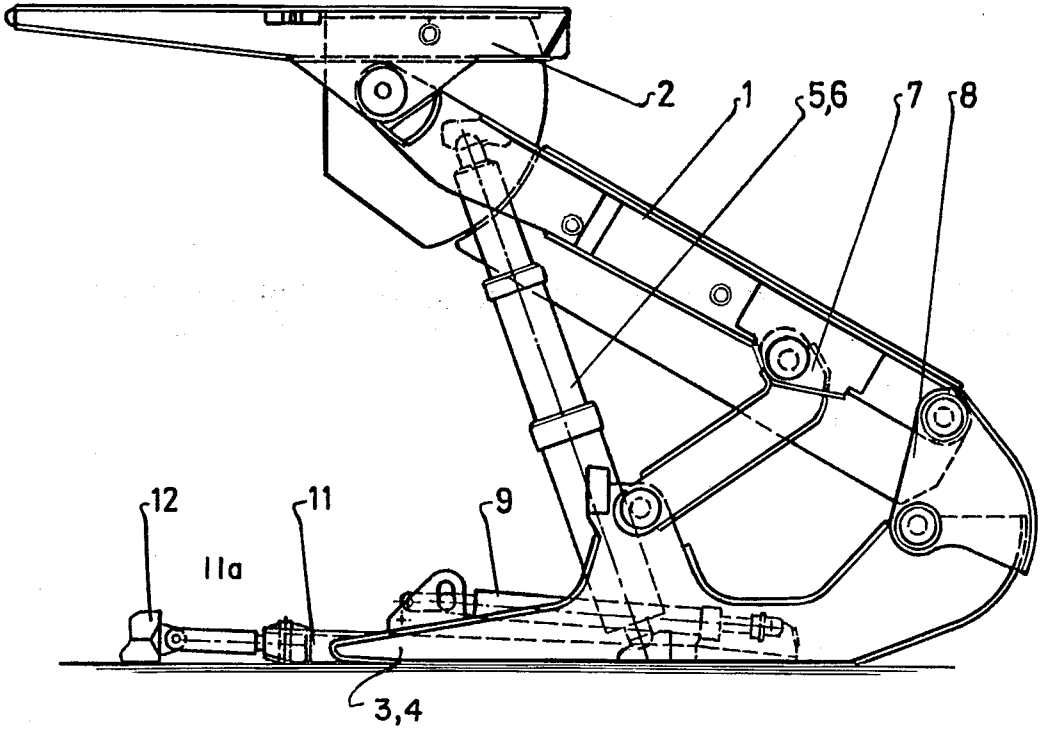
FIG. 1 is a side elevational view of a shield timbering frame with lemniscate conduction and a divided footwall skid, constructed in accordance with the invention.
Figure 3:
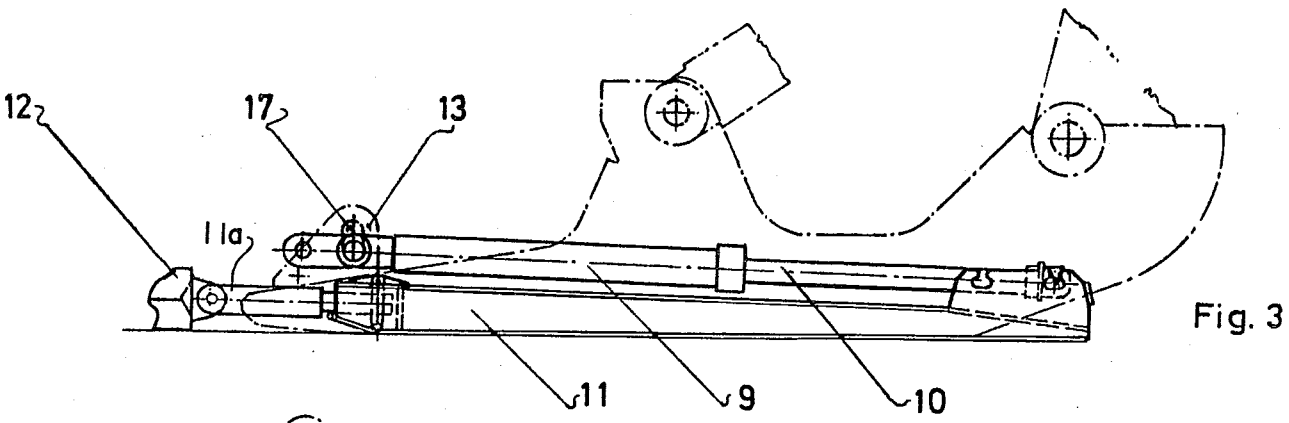
FIG. 3 is a partial median longitudinal section in the region of the footwall skid, but on a larger scale, of the device shown in FIG. 1.

Referring to the drawings in particular, the invention embodied therein, comprises, a coupling gear for connecting two side-by-side longitudinally extending shiftable skids 3 and 4 of a divided footwall skid of a lemniscate shield timbering frame, which includes a roof structure 1, which is articulated with a wall shield 2 and has two pivot joints 7 and 8 for pivotally supporting the structure on the skids 3 and 4. The structure is shiftable relative to a roof or wall of an excavation by moving skids 3 and 4 relative to each other with the coupling gear construction in accordance with the invention.

In the shield timbering frame shown, a rigid shield roof 1, which extends over the entire width of the frame and carries a hanging wall shield 2 at the upper end is mounted on a footwall skid with the skid halves 3 and 4, and is supported by means of two hydraulic rams 5 and 6. Instead of a simple shaft joint, two joint parts 7 and 8, by which the desired lemniscate conduction is given, are provided for the articluated connection of the shield roof 1 with the footwall skid.

Figure 5:
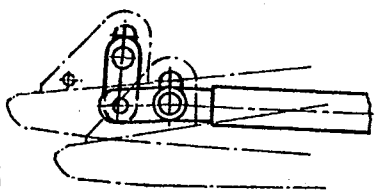
FIG. 5 is a partial side elevational view of the coupling gear.
Figure 4:
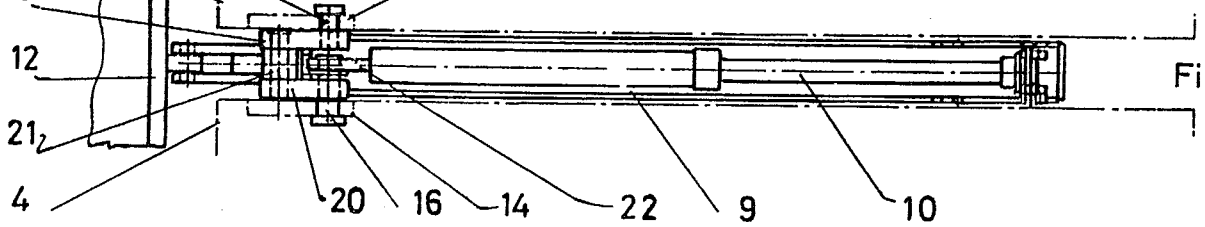
FIG. 4 is a partial top view of the moving cylinder and the coupling gear.

When only one of the two hydraulic rams 5 or 6 is in use for the support of the hanging wall roof, and by means of the other, the associated skid half 3 or 4 is raised by reverse pressurization, and the skid tip executes a forwardly directed movement so that, in the end, the skid half 3 occupies the position shown in FIG. 5 which is raised relative to the other skid half 4.

A moving cylinder 9 which extends between the two skid halves 3 and 4 is provided for the advance of the shield timbering frame. At its rear end, cylinder 9 is connected through a coupling gear, which will be explained in more detail hereinafter, with the skid halves in the vicinity of their front ends, while piston rod 10, associated with the cylinder 9, is articulated by its head to a thrust beam 11 which extends below the moving cylinder 9 beyond the front end of the skid halves 3 and 4, and is connected with a conveyor 12 directly or through a moving beam 11*a*.

Figure 6:
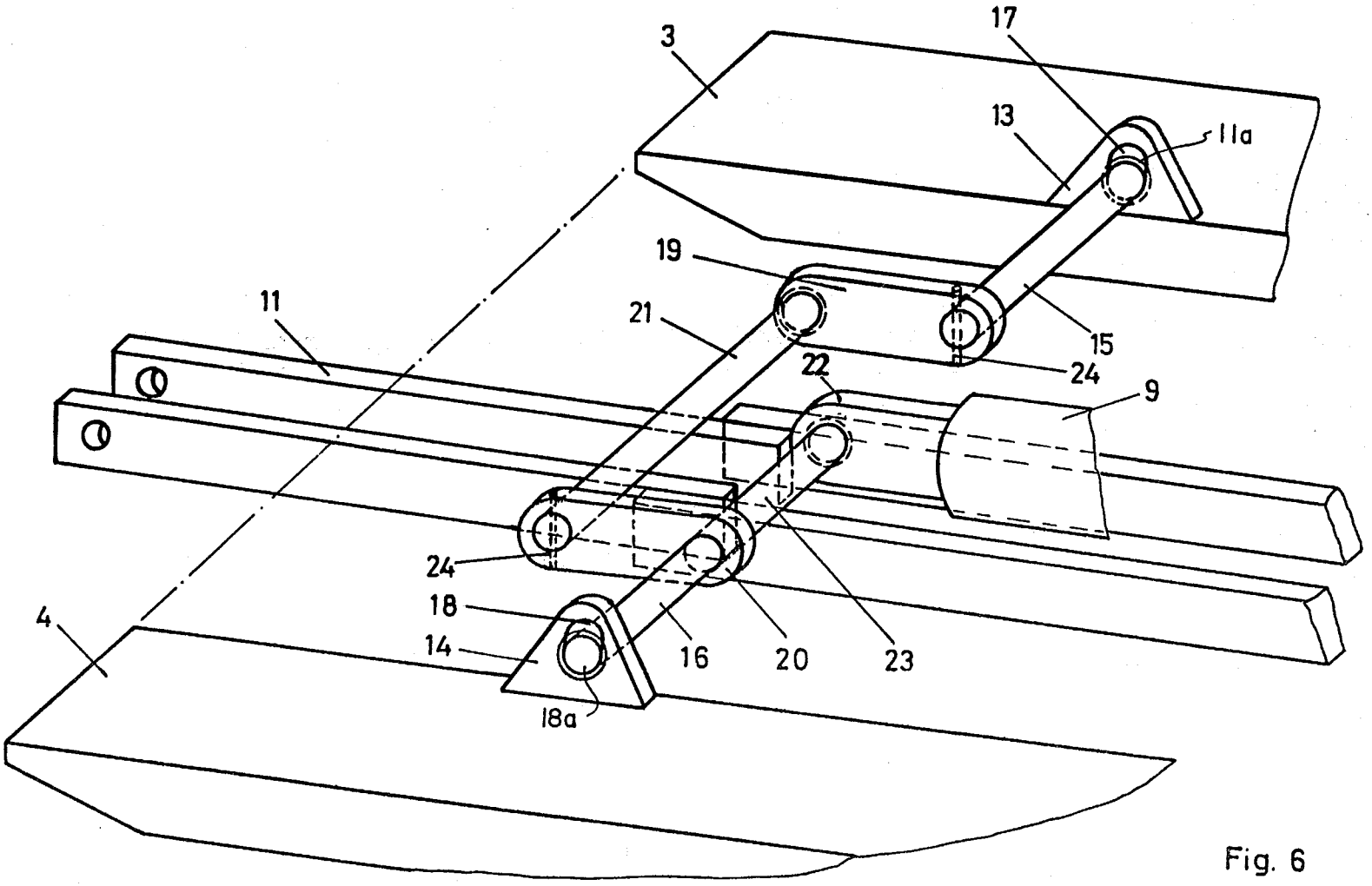
FIG. 6 is an enlarged partial perspective view of the coupling gear, the individual parts being shown exploded for greater clarity.
Figure 7:
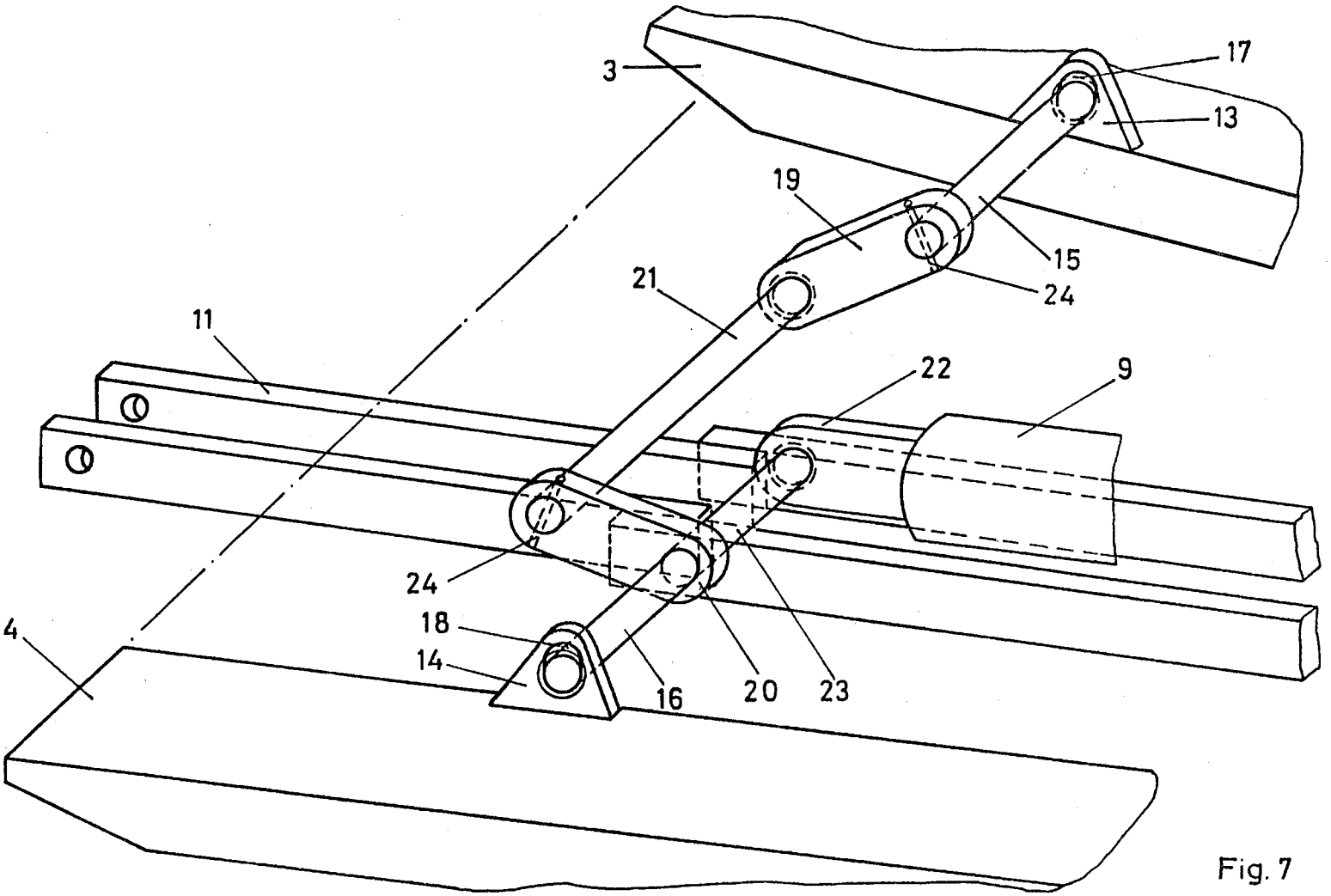
FIG. 7 is a perspective view, similar to FIG. 6, with the difference that one skid half occupies a raised position.

As is evident in particular from FIGS. 6 and 7, the actual coupling gear is mounted on two brackets 13 and 14 which are fastened to respective skid halves 3 and 4 and extend parallel to the longitudinal direction thereof. The coupling gear comprises a double crank joint, having outer crank pins 15 and 16, which are mounted freely rotatable by their ends in respective vertically elongated slots 17 and 18 but are secured against axial (longitudinal) displacements. In order to prevent axial displacements, suitable collars 17*a* and 18*a* are provided at the outer ends of the respective crank pins 15 and 16.

At the inner ends, the crank pins 15 and 16 are in connection through parallel longitudinally extending crank arms 19 and 20 with a common central crank pin 21. An outer crank pin 15 is mounted non-rotationally on the crank arm 19, but the central crank pin 21 is freely rotatable. The situation is reverse for the crank arm 20, that is, the outer crank pin 16 is freely rotatable in the crank arm 20 and the central crank pin 21 is non-rotational in the crank arm 20. The outer crank pin 16 is extended inwardly beyond the crank arm 20 and beyond the median plane of the timbering frame and serves as the force-transmitting connection of cylinder 9 which has a connecting rod plate 22 at its rear end. Plate 22 has a bore into which the inner extension 23 of crank pin 16 extends.

Pins or studs 24 insure a non-rotational connection of the crank pins 15 and 21 with the respective crank arms 19 and 20, and they pass through aligned bores in the crank arm and in the crank pins.

When the two skid halves 3 and 4 are at the same level, the crank arms 19 and 20 extend, as shown in FIG. 6, approximately parallel to the bearing plane of the timbering frame. With the raising of one skid half, the two crank joints execute different pivotal movements. FIG. 7 shows the position of the crank joints or crank arms in the case where skid half 3 is raised relative to skid half 4. In this position, the tip of skid half 3 is farther forward than the tip of skid half 4.

While a specific embodiment of the invention has been shown and described in detail to illustrate the application of the principles of the invention, it will be understood that the invention may be embodied otherwise without departing from such principles.

What is claimed is:

1. A coupling gear for connecting two side-by-side longitudinally extending shiftable skids of a divided footwall skid of a lemniscate shield timbering frame for actuation by a fluid pressure operated piston and cylinder combination which is adapted to be connected thereto, comprising, a double crank joint including a first and a second outer crank pin extending transversely between the skids, bracket means adapted to be positioned on the respective skids for rotatably supporting said outer crank pins on the respective skids, said first and second outer crank pins having outer ends rotatably supported in said bracket means and having opposite inner ends, first and second longitudinally extending, substantially parallel crank arms, said first crank arm having a first end non-rotatably connected to said inner end of said first outer crank pin and having an opposite second end, said second crank arm having a first end freely rotatable on said second outer crank pin and having an opposite second end, a central crank pin having a first end freely rotatable in said first crank arm opposite end and non-rotatably connected to said second crank arm opposite end, one of said crank pins being extended inwardly of its associated crank arm and providing a connection to said piston and cylinder combination.

2. A coupling gear, as claimed in claim 1, wherein said second crank pin is extended inwardly and provides the connection to said piston and cylinder combination.

3. A coupling gear, as claimed in claim 1, wherein said bracket means include vertically elongated bearing slots in which the associated first and second outer crank pin outer ends are rotatably supported, the width of said slots in a horizontal direction being of the same dimension as the diameter of said outer crank pins.

4. A coupling gear, as claimed in claim 1, wherein said first and second crank arms have the shape of a straight cheek.

5. A coupling gear, as claimed in claim 1, wherein said non-rotational connection of said first crank arm with said outer crank pin and said second crank arm with said central crank pin comprises a crossbore of said first outer crank pin which is alignable with a crossbore of said first crank arm with a cross pin extending through said crossbores and a crossbore of said second crank arm and a corresponding crossbore of said central crank pin which is alignable therewith with a second cross pin extending through said aligned crossbores.

* * * * *